US008196761B2

(12) United States Patent
Morandi

(10) Patent No.: US 8,196,761 B2
(45) Date of Patent: Jun. 12, 2012

(54) EASILY ASSEMBLED SHELVING SYSTEM OF SMALL OVERALL SIZE

(75) Inventor: Sergio Morandi, Vacallo (CH)

(73) Assignee: Metaltex Italia S.p.A., Maslianico (IT)

( * ) Notice: Subject to any disclaimer, the term of this patent is extended or adjusted under 35 U.S.C. 154(b) by 0 days.

(21) Appl. No.: 13/044,036

(22) Filed: Mar. 9, 2011

(65) Prior Publication Data

US 2011/0220603 A1 Sep. 15, 2011

Related U.S. Application Data

(60) Provisional application No. 61/312,850, filed on Mar. 11, 2010.

(51) Int. Cl.
*A47B 47/03* (2006.01)
*A47B 55/02* (2006.01)

(52) U.S. Cl. ..... 211/186; 211/133.5; 108/91; 108/181

(58) Field of Classification Search ..... 211/133.5, 211/133.1, 153, 186, 195; 108/180, 181, 108/186, 187, 91
See application file for complete search history.

(56) References Cited

U.S. PATENT DOCUMENTS

| | | | | | |
|---|---|---|---|---|---|
| 2,799,401 | A * | 7/1957 | Duchin | 108/181 |
| 2,864,512 | A * | 12/1958 | Hoose | 108/181 |
| 3,172,376 | A * | 3/1965 | Havlis | 108/59 |
| 3,252,434 | A * | 5/1966 | Young, Jr. | 108/181 |
| 3,367,510 | A * | 2/1968 | Krikorian | 211/133.5 |
| 3,374,900 | A * | 3/1968 | Rollins, Jr. | 211/133.2 |
| 3,387,855 | A * | 6/1968 | Oliver | 280/79.3 |
| 3,435,958 | A * | 4/1969 | Chesley | 211/133.2 |
| 3,977,529 | A * | 8/1976 | Stroh | 211/187 |
| 4,122,955 | A * | 10/1978 | Celms | 211/133.5 |
| 4,754,885 | A * | 7/1988 | Rich | 211/132.1 |
| 5,065,873 | A * | 11/1991 | Tseng | 211/187 |
| 2007/0102385 | A1* | 5/2007 | Killinger et al. | 211/126.7 |
| 2008/0203042 | A1* | 8/2008 | Felsenthal | 211/153 |
| 2010/0126951 | A1* | 5/2010 | Winn et al. | 211/133.5 |
| 2010/0288717 | A1 | 11/2010 | Morandi | |

* cited by examiner

*Primary Examiner* — Michael Safavi
*Assistant Examiner* — Devin Barnett
(74) *Attorney, Agent, or Firm* — Novak Druce + Quigg, LLP

(57) ABSTRACT

Shelving system has first and second lateral support elements for a plurality of shelves. The shelves formed from metal wire mesh structure and including a base wall and at least two mutually parallel side walls. The support elements and shelves including, respectively, elements and counter-elements for removably connecting shelves to support elements. The two side walls connected to the base wall and shaped for stacking one shelf on another with base walls of the shelves mutually superposed, one in contact with another, to reduce overall disassembled system size. Each shelf base wall lower face has at least one seat sunken with respect to side walls, to at least partly house at least a portion of one support element. The shelves shaped for housing, in the upper face of the base wall between the side walls, at least a portion of the other support element, to reduce overall disassembled system size.

13 Claims, 6 Drawing Sheets

EASILY ASSEMBLED SHELVING SYSTEM OF SMALL OVERALL SIZE

CROSS-REFERENCE TO RELATED APPLICATION

This application claims the benefit of U.S. provisional application No. 61/312,850 filed Mar. 11, 2010, incorporated herein by reference.

BACKGROUND OF THE INVENTION

The present invention relates to a shelving system in accordance with the pre-characterizing part of the main claim. Shelving systems of the aforeindicated type have been known for some time, in particular for forming small furniture units with three shelves for example for use as shoe holders or in a bathroom.

Known systems are usually marketed in disassembled form to reduce their overall size and consequently their storage and dispatch costs.

SUMMARY OF THE INVENTION

An object of the present invention is to provide a shelving system which, when disassembled, is of smaller overall size than known systems.

A further object is to provide a system which simplifies and accelerates the operations involved in assembling the system and in particular which simplifies the fitting of the shelves to the relative support elements.

These and other objects which will be apparent to an expert of the art are attained by a system in accordance with the characteristics of the accompanying claims.

BRIEF DESCRIPTION OF DRAWINGS

The present invention will be more apparent from the accompanying drawings, which are provided by way of non-limiting example and in which.

DETAILED DESCRIPTION OF THE INVENTION

Figure 1:
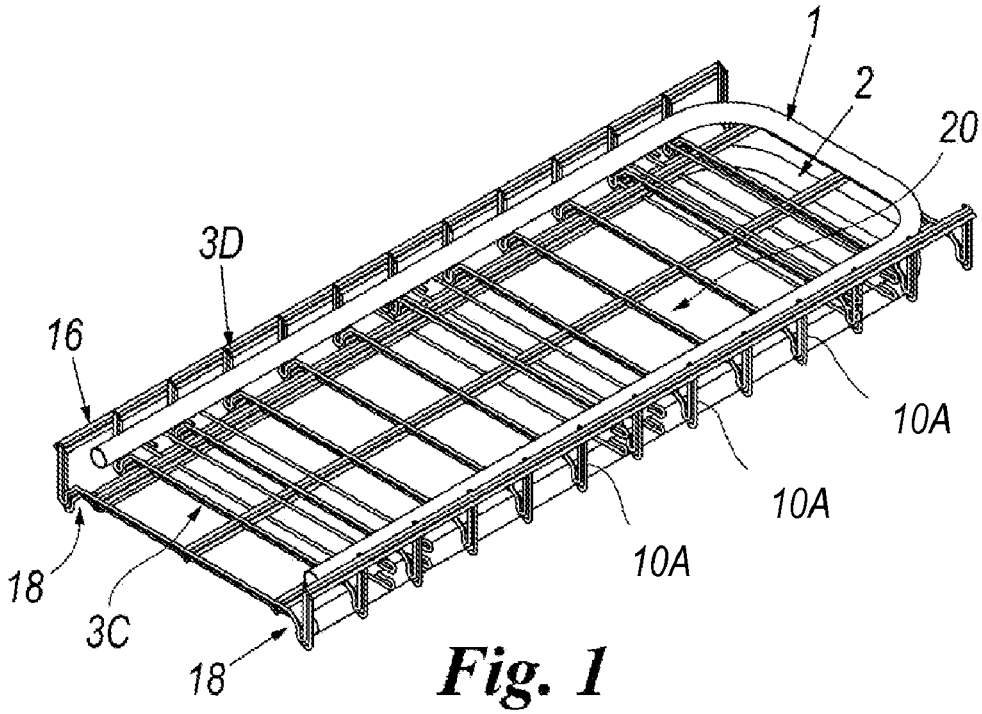
FIG. 1 shows a three shelf shelving system according to the invention, represented as a perspective schematic view from above.

With reference to said figures, these show a first and a second lateral support element 1, 2 for a plurality of shelves 3 formed from connected-together metal wires, said support elements and shelves comprising, respectively, means 4 (FIG. 10) and counter-means 5 for removably connected said shelves to said support elements. Advantageously the connection means 4 comprise:

- a coupling element 4A comprising a first and a second portion 6, 7 (FIG. 10) spaced apart but connected together by a connection portion 8 in order to define a seat 9 of substantially U cross-section, i.e. of hook form, into which the connection counter-means 5 provided in said shelf 3 are inserted,
- said first and second portion 6, 7 being spaced apart by a distance T substantially equal to the thickness S of those wires of the shelf 3 provided at the corners of said shelves,
- and a connection element 11 adapted to connect said coupling elements 4 to said support elements 1, 2 in predetermined positions.

Figure 7:
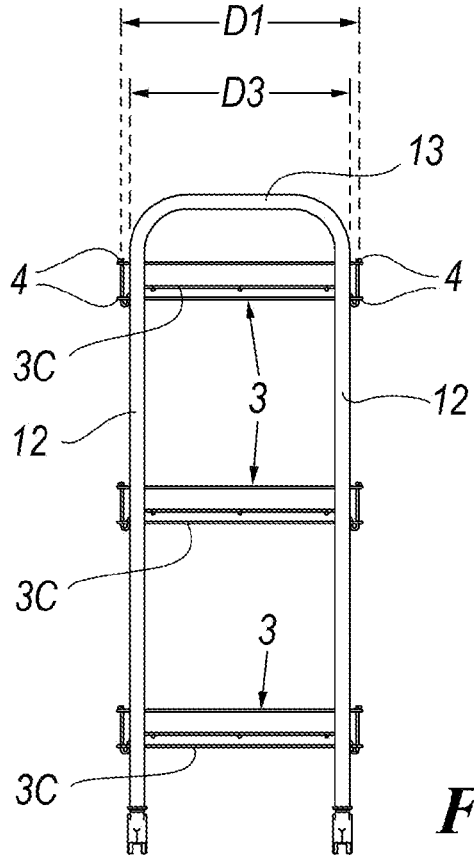
FIG. 7 shows the system in an assembled state, represented as an orthogonal frontal.
Figure 8:
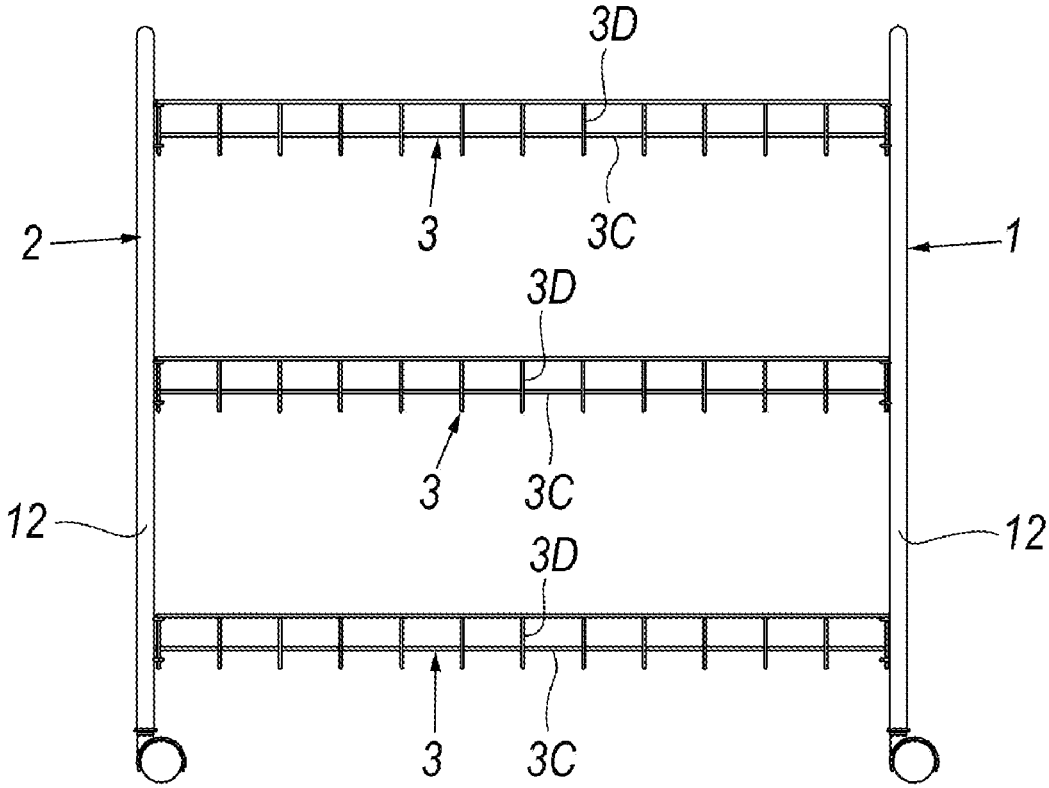
FIG. 8 shows the system in an assembled state, represented as a lateral view.

Preferably the connection counter-means 5 comprise a vertical substantially filiform element 10 to be inserted into the seat 9 in contact with the portions 6-8 of the coupling element 4A. For a determined shelf 3, the distance D1 (FIG. 7) between the coupling elements 4A provided on each support element 1, 2 is substantially equal to the distance D2 (FIG. 5) between the filiform elements 10A to be inserted into said coupling elements 4A, to hence ensure a stable connection of the shelves to the support elements without slack.

More particularly, the support elements 1 and 2 preferably comprise an inverted U-shaped tubular structure of uniform cross-section Z (FIG. 5*b*) comprising two uprights 12 connected together by an upper crosspiece 13. the connection means 4 for the shelves 3 comprise, in predetermined equidistant positions on the uprights 12 of the two support elements 1 and 2, pairs of coupling elements 4A spaced apart preferably by a distance R (FIG. 11) of length less than that of the corner metal wires 10A which engage said coupling elements. These coupling elements 4A are preferably formed by bending the ends of a single metal wire 33 (FIG. 10) rigidly secured transversely to the uprights 12 of each support element 1, 2 in predetermined positions, with the coupling elements 4A projecting outwards from said support elements, i.e. such that the distance D1 between the coupling elements 4A is greater than the distance D3 (FIG. 7) between the uprights 12.

Figure 9:
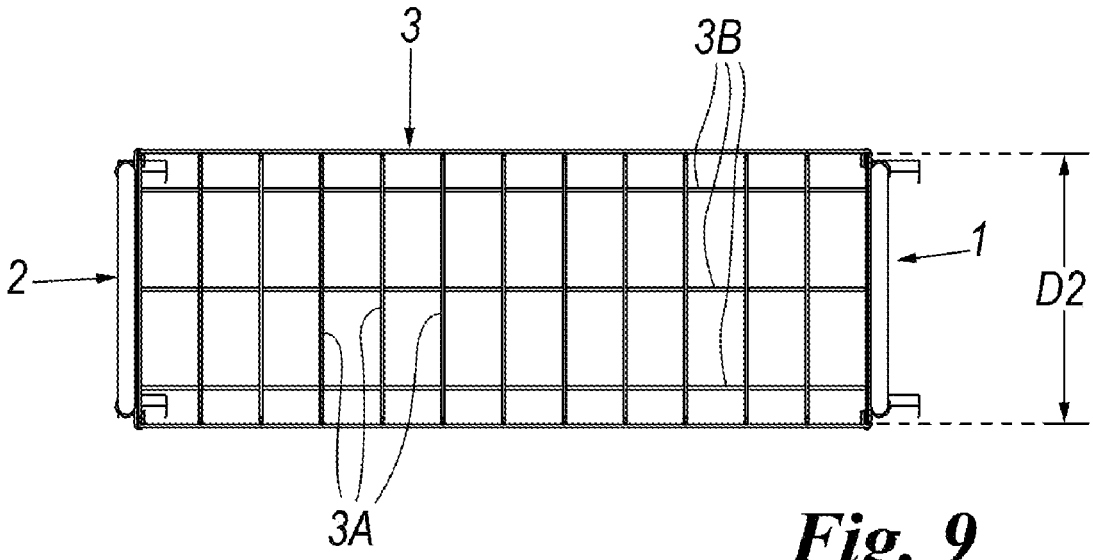
FIG. 9 shows the system in an assembled state, represented as a top view.

The shelves 3 are advantageously formed by welding together a plurality of transverse metal wires 3A and longitudinal metal wires 3B (FIG. 9) to form a mesh type structure.

According to the invention, the shelves are characterized by comprising:

- a base wall 3C (FIG. 1) and only two side walls 3D extending parallel to each other from said base wall, said side walls 3D being connected to said base wall 3C and being shaped to enable one shelf to be stacked on another with the base walls of the various system shelves in mutual contact, to hence reduce the overall system size when disassembled,
- and, in a lower face 19 of said base wall 3C, at least one sunken seat 18, able to at least partly house at least a portion of one (2) of the support elements, the other support element (1) being housed on the upper face 20 of said base wall, preferably between the side walls 3D of the shelves.

Advantageously, the support elements 1, 2 and the shelves 3 are dimensioned such that, when the shelves are stacked one on another with their base walls 3C in mutual contact, the uprights 12 and the crosspiece 13 of the support elements 1, 2 are completely housed in the stacked shelves, preferably such that one of the support elements (2) rests on the lower face 19 of the last shelf of the stack and completely received in the seat defined by the base wall 3C of the last shelf and lower portions of the side walls of the stacked shelves, and the other support element 1 rests on the upper face 20 of the base wall 3C of the first shelf of the stack, and completely received in said first shelf. In order to reduce the overall system size to a minimum, the height D5 (FIG. 5*b*) of the shelf side walls 3D is substantially equal to or slightly greater (1-10 mm greater) than the sum of twice the diameter Z (FIG. 5*b*) of the support elements 1, 2 and the thickness V (FIG. 11) of the base wall 3C, i.e.: $2Z+V \leqq D5+K$ where $1\ mm \leqq K \leqq 10\ mm$.

According to the invention, by virtue of the particular shape of the base wall of the shelves, and of the particular dimensioning of the support elements, when the system is disassembled and the shelves are inserted one into another with the respective base walls in mutual contact, the support elements are completely within the stacked shelves, i.e. inserted one into another with their base walls in mutual contact, by which means the overall system size is reduced by 30/40% compared with known systems, with considerable advantages in transporting and storing this type of system.

Figure 5:
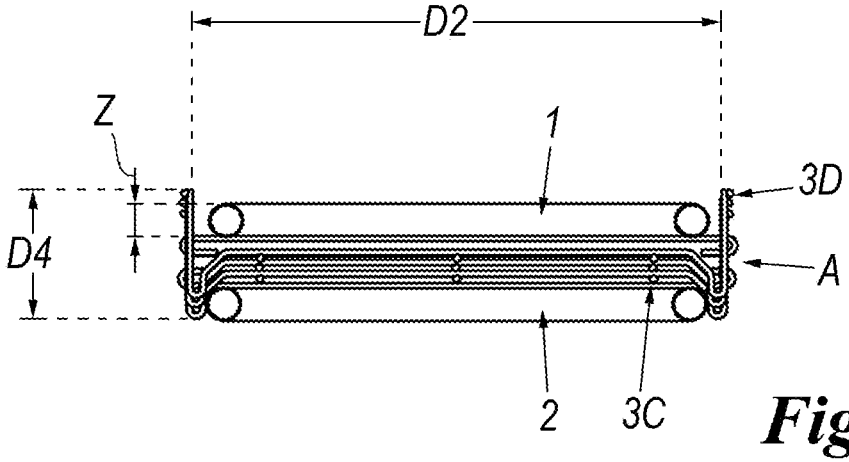
FIG. 5 shows a frontal view of the three shelf shelving system of FIG. 1 in a disassembled state.

To form the sunken seat 18 in the shelves according to the invention, preferably the base wall 3C is not provided at the lower end 3F (FIG. 5*b*) of the side walls 3D of the shelves, but in a substantially intermediate position between said lower end 3F and an upper end 3G of said side walls 3D, and in any event in a position such as to enable both the two support elements 1 and 2 to be housed within the stacked shelves without projecting from the wall ends 3F, 3G. FIG. 5 shows the stacked shelves have a height D4.

Advantageously, to reduce the overall height of the support element 1 which rests on the upper face of the base wall 3C of the upper shelf of the stack of shelves, that base wall 3C in proximity to the side walls 3D upperly presents a sunken portion 25 (FIG. 5*b*) able to at least partly house the coupling element 4A of the connection means 4 of said support elements, and in particular the portion 6 of said coupling element 4A.

Figure 5B:
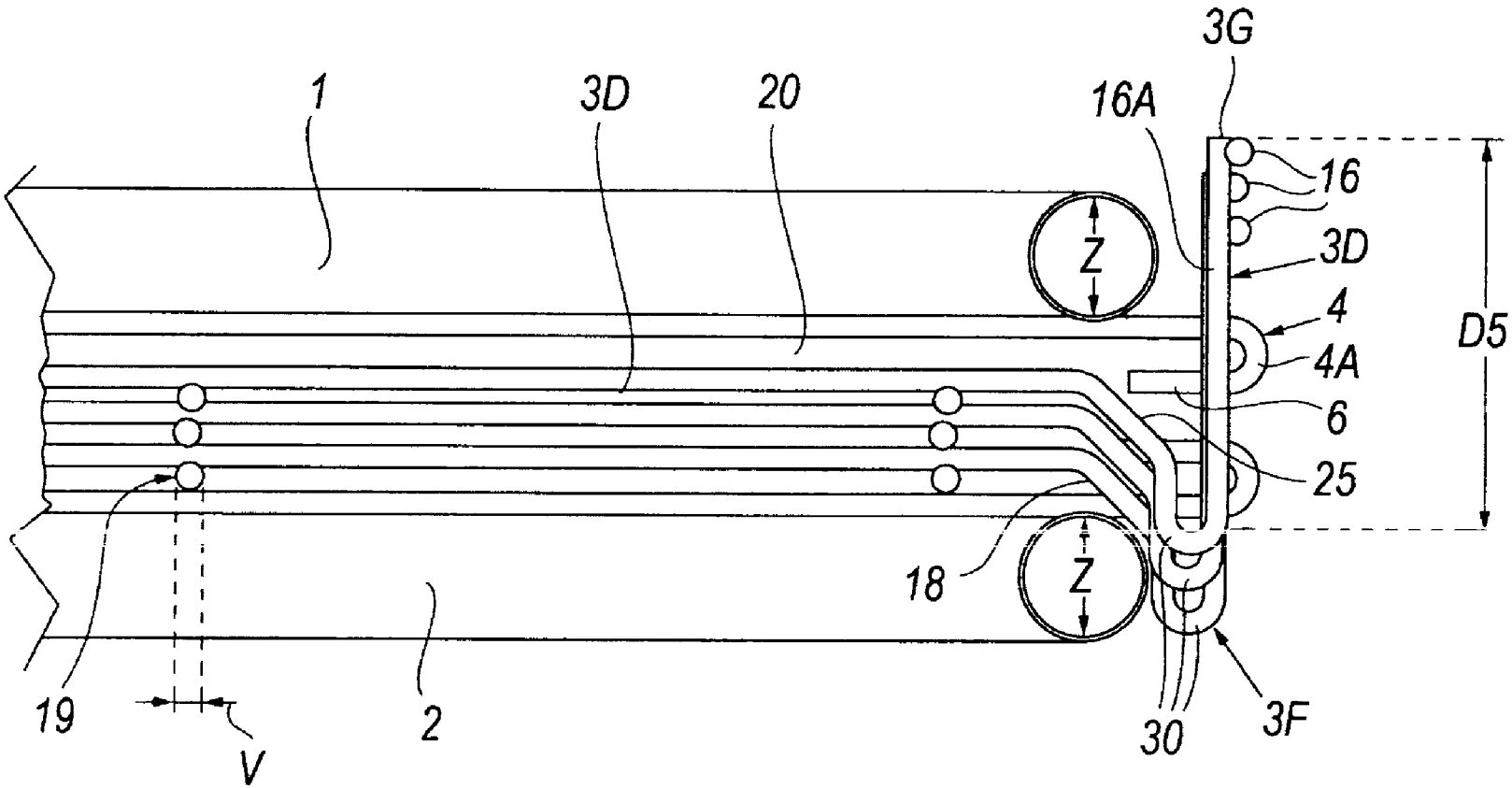
FIG. 5*b* shows an enlargement of the detail indicated by the arrow A in FIG. 5.
Figure 6:
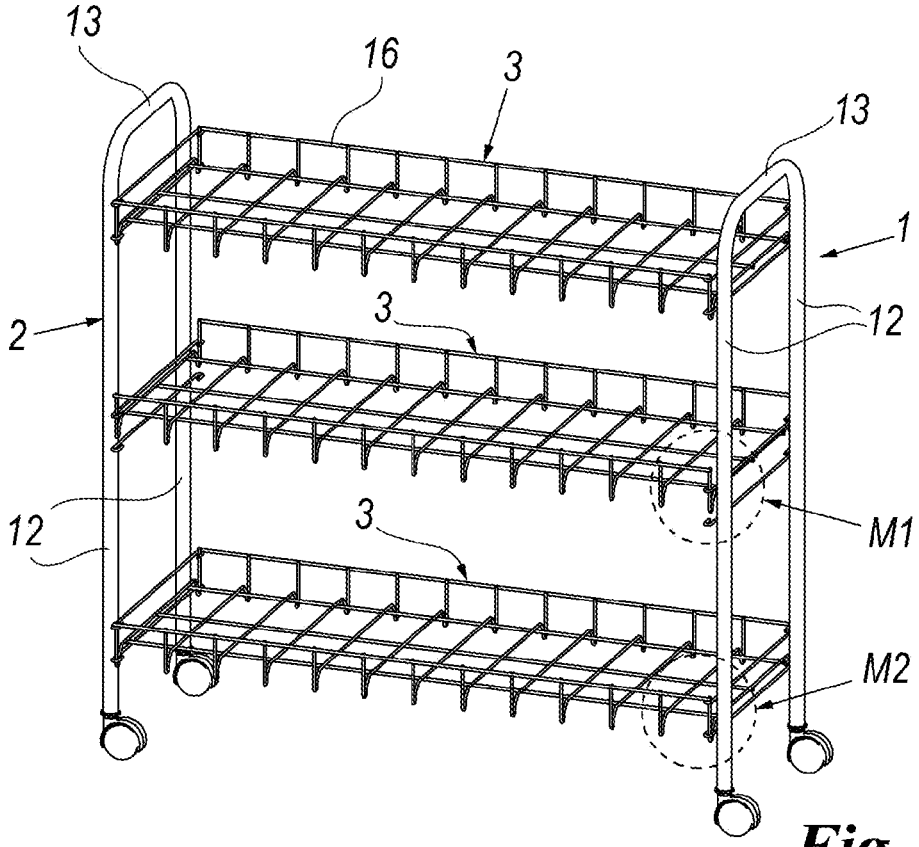
FIG. 6 shows the system in an assembled state, represented as a perspective view.

It should also be noted that according to the invention the apertures of the side walls 3D of the baskets 3 are sufficiently spaced apart to enable the connection elements 1, 2 to be inserted into the baskets such that the coupling elements 4A secured to said connection elements 1, 2 partly project outwards from said apertures when the system is disassembled (as shown in FIG. 5*b*).

Advantageously the base wall 3C and the side walls 3D are formed by suitably bending a plurality of transverse metal wires common both to said walls and to the base, and then connecting said transverse wires to a plurality of longitudinal wires separate for the base and for the walls.

Figure 2:
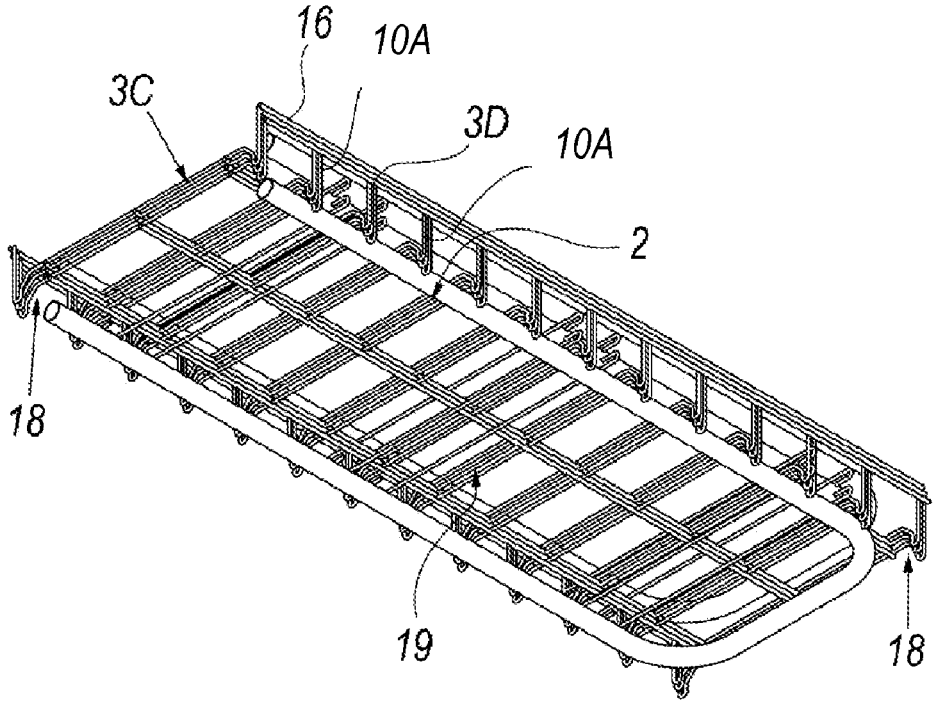
FIG. 2 shows a perspective schematic view from below of the three shelf shelving system of FIG. 1.
Figure 3:
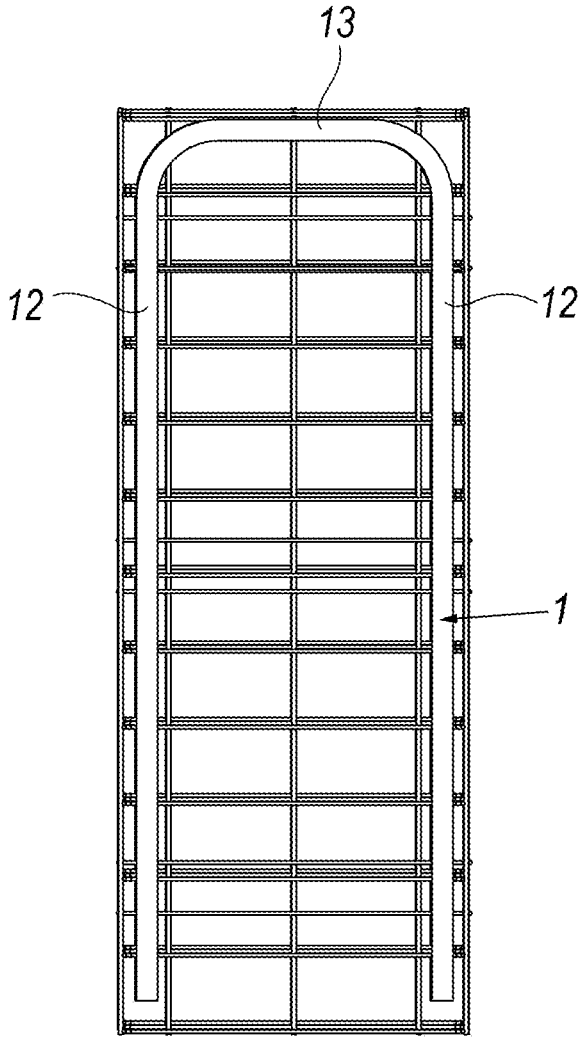
FIG. 3 shows as an orthogonal view from above of the three shelf shelving system of FIG. 1 in a disassembled state.
Figure 4:
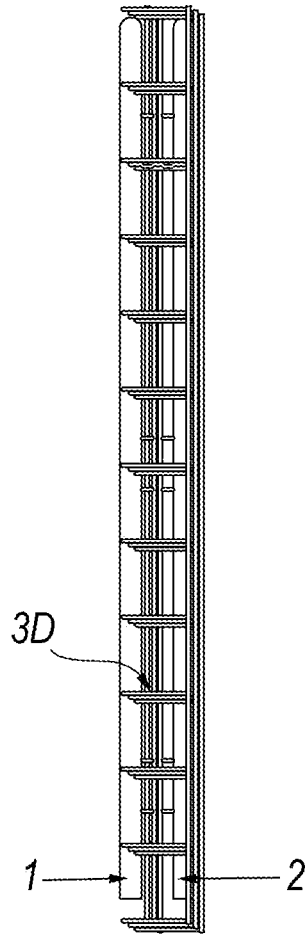
FIG. 4 shows a lateral view of the three shelf shelving system of FIG. 1 in a disassembled state.

Preferably, to facilitate insertion of one shelf into another, the side walls 3D comprise a single longitudinal metal wire 16 (FIGS. 1 and 5*b*) provided at the upper end 3G of said walls 3D, i.e. secured to the ends 3G of a plurality of transverse wires 16 (FIG. 2).

In addition, to facilitate shelf stacking, the side walls 3D are connected to the base 3C by U bends 30 (FIG. 5*b*) of those transverse metal wires common both to the base wall 3C and to the side walls 3D.

Preferably, the shelf side walls 3D are provided along the major side of the shelves, while the shelf minor sides are without side walls.

At their ends the shelves comprise an end transverse metal wire 15 (FIG. 11) welded to the longitudinal wires 3B such that they do not project from said wire 15, which hence in all respects forms the end edge of the shelves 3. The end transverse wire 15 comprises a substantially horizontal portion 15A (FIG. 10), from the ends of which there extend two vertical portions which form the aforesaid corner metal wires 10A which engage the coupling elements 4A.

Figure 10:
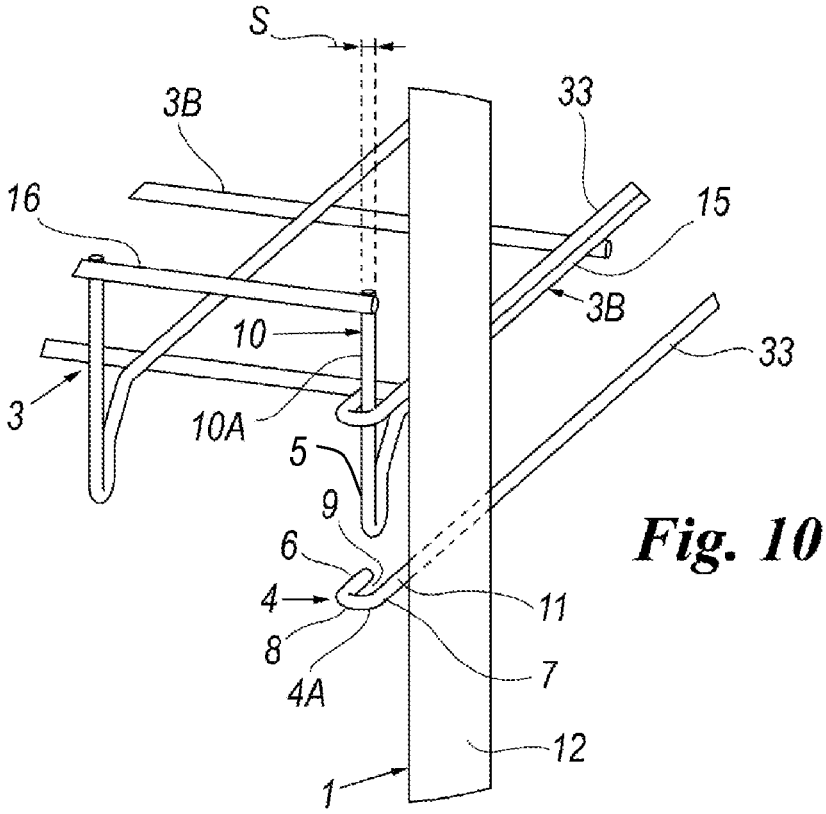
FIG. 10 shows a system detail indicated by M1 in FIG. 6, in a first separate stage of its assembly.
Figure 11:
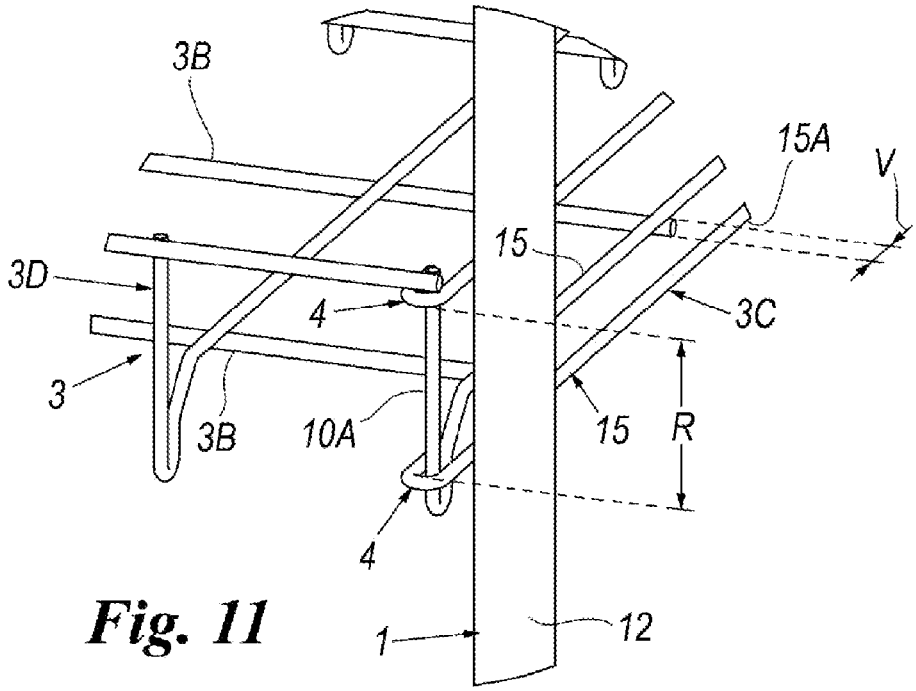
FIG. 11 shows a system detail indicated by M2 in FIG. 6, in a second separate stage of its assembly.

As shown in FIGS. 10 and 11, to assemble the shelving system, the shelves need merely be slid from the top downwards with slight friction into the relative coupling elements 4 until the end wire 16 of the side walls 3D abuts (FIG. 11) against the coupling elements 4 to prevent further descent of the shelf. In this assembly stage the horizontal portion 15A (FIG. 10) of the end wire 15 of the shelves 3 slides under friction along an inner surface of the uprights 12 of the support structures 1, 2 (as shown in FIGS. 11 and 10), and with the shelf coupled, it remains abutting against said inner surface to further stabilize the system.

It should be noted that the shelves, the support elements 1, 2 and the relative coupling means and counter-means 4 and 5 are shaped and dimensioned such that when the shelves 3 are inserted into the relative coupling elements 4A, those parts of the shelves and of the coupling elements and support elements in mutual contact are in fact in strict mutual contact such as to prevent slack between the various shelf components and render the system stable and not unsteady; to this end, if necessary, when the shelves are unpacked, the angle of inclination of the shelf side walls 3D to the base wall 3C can be varied slightly.

Because of the fact that the distance D3 (FIG. 7) between the uprights 12 of the support structures 1 and 2 is less than the distance D2 (FIG. 9) between the side walls 3D of the shelves (i.e. less than that between the filiform elements 10A which are to be inserted into the coupling elements 4A of the end wire 15 of the shelves) when the system is disassembled to the support elements 1, 2 can be housed within the shelves (as shown in FIG. 5*b*).

Finally, it should be noted that the aforeillustrated embodiments have been provided by way of example only, and that numerous variants are possible, all falling within the same inventive concept, for example the coupling elements 4A could comprise usual members enabling them to be removably positioned on the uprights 12. For this purpose the uprights could comprise a plurality of uniformly spaced-apart holes, and the coupling elements 4A could comprise, starting from the bar 33 which connects two coupling elements together, pegs 23 adapted to engage in said holes.

The invention claimed is:

1. A shelving system comprising:

a first and a second lateral support element for supporting a plurality of shelves, said shelves being formed from metal wires secured together to form a mesh structure and comprising a base wall and at least two mutually parallel side walls, said support elements and shelves comprising, respectively, connecting means and counter-means for removably connecting said shelves to said support elements;

wherein:

said two side walls are connected to said base wall and are shaped to enable one shelf to be stacked on another with the base walls of the shelves mutually superposed, one in contact with another, to reduce the overall size of the system when disassembled, wherein the support elements and the shelves are dimensioned such that, when the shelves are stacked one on another with their base walls in mutual contact, said support elements are completely housed within the stacked shelves, each of said shelves comprises, on a lower face of the base wall, at least one shelf sunken seat being sunken with respect to said side walls, to at least partly house at least a portion of one of said support elements, wherein said one of the support elements is totally received within the sunken seat defined by the base wall and by lower portions of the side walls of the lowermost shelf of the stacked shelves, said shelves being shaped for housing, in an upper face of said base wall between said side walls, at least a portion of the other support element, to further reduce the overall size of said system when disassembled, said other support element resting on the upper face of the base wall of the uppermost shelf of the stack, and being completely received between an upper portion of the side walls of said uppermost shelf.

2. The shelving system as claimed in claim 1, wherein the shelves each have only two side walls.

3. The shelving system as claimed in claim 1, wherein the height D of the side walls of the shelves is substantially equal to, or greater by a value between 1 and 10 mm than, the sum of twice the diameter Z of the tubular support elements plus the thickness V of the base wall, i.e.: $2Z+V \leqq D5+K$ where $1\ mm \leqq K \leqq 10\ mm$.

4. The shelving system as claimed in claim 1, wherein the base wall is provided in a substantially intermediate position between a lower end and an upper end of the side walls of the shelves, to form the at least one sunken seat for housing the support elements within the stacked shelves without projecting from the ends of the side walls.

5. The shelving system as claimed in claim 1, wherein the base wall of the shelves in proximity to the side walls presents on an upper side a sunken portion for at least partly housing a coupling element of the connecting means of said support elements, to reduce the overall height of the support element which rests on the upper face of the base wall of the uppermost shelf of the stack of shelves.

6. The shelving system as claimed in claim 1, wherein apertures of the mesh structure of the side walls of the shelves are spaced apart by a distance such that coupling elements of the connecting means of the support elements can copenetrate with said apertures and partially project outwards from said apertures, to enable the connecting means to be inserted into said shelves when the system is disassembled.

7. The shelving system as claimed in claim 5, wherein the sunken portion of the base wall is inclined to the side walls.

8. The shelving system as claimed in claim 1, wherein the base wall and the side walls of the shelves are formed by bending a plurality of transverse metal wires common both to said side walls and to said base wall, and then connecting said transverse wires to a plurality of longitudinal wires separate for the base and for the walls.

9. The shelving system as claimed in claim 8, wherein each of the side walls comprise a single respective longitudinal metal wire of the said plurality of longitudinal wires secured to ends of the plurality of transverse wires, to facilitate the insertion of one shelf into another.

10. The shelving system as claimed in claim 8, wherein the side walls are connected to the base wall by U bends of those transverse wires common both to the base wall and to the side walls, to facilitate shelf stacking.

11. The shelving system as claimed in claim 1, wherein the connecting means comprise at least one coupling element shaped to define a hook-shaped seat having a substantially U cross-section, in which to insert the counter-means provided in each shelf, said counter-means comprising at the corners of each shelf at least a first substantially filiform vertical portion, said hook-shaped seat of the at least one coupling element being dimensioned to enable said filiform portion to be inserted with friction therein, such that a length of said filiform portion remains in contact with the inner surface of said hook-shaped seat when the shelf is connected to the support elements.

12. The shelving system as claimed in claim 11, wherein the at least coupling element is a plurality of coupling elements that are opposed ends of a metal wire secured transversely to uprights of each support element in predetermined positions, said coupling elements projecting outwards from said uprights such that the distance between ends of the coupling elements is greater than the distance between said uprights, the counter-means being insertable into the coupling elements.

13. A method for packaging a shelving system in a disassembled state, comprising:

providing said system of claim 1 comprising:

a first and a second lateral support element for supporting a plurality of shelves, said shelves being formed from metal wires secured together to form a mesh structure and comprising a base wall and at least two mutually parallel side walls, said support elements and shelves comprising, respectively, connecting means and counter-means for removably connecting said shelves to said support elements;

wherein:

said two side walls are connected to said base wall and are shaped to enable one shelf to be stacked on another with the base walls of the shelves mutually superposed, one in contact with another, to reduce the overall size of the system when disassembled, wherein the support elements and the shelves are dimensioned such that, when the shelves are stacked one on another with their base walls in mutual contact, said support elements are completely housed within the stacked shelves, each of said shelves comprises, on a lower face of the base wall, at least one shelf sunken seat sunken with respect to said side walls, to at least partly house at least a portion of one of said support elements, said shelves being shaped for housing, in an upper face of said base wall between said side walls, at least a portion of the other support element, stacking the shelves of said system one on another, with their base wall in mutual contact, and with one of two support elements of the system at least partly housed in at least one said shelf sunken seat, which is sunken with respect to the side walls of the shelves and is provided in the base of the shelves, wherein one of the support elements is totally received within the sunken seat defined by the base wall and by lower portions of the side walls of the lowermost shelf of the stacked shelves, the other support element being at least partly housed on the upper face of said base wall of the shelves between said side walls, to reduce the overall size of said system when disassembled, the other support element resting on the upper face of the base wall of the uppermost shelf of the stack, and being completely received between an upper portion of the side walls of said uppermost shelf.

* * * * *